US005347436A

United States Patent [19]

Clyde et al.

[11] Patent Number: 5,347,436

[45] Date of Patent: Sep. 13, 1994

[54] COMBINATION BATON/LIGHT EMITTING DEVICE

[75] Inventors: Arthur C. Clyde, Teaneck, N.J.; Andrew I. Sneider, New York, N.Y.; Patricia L. Watson, Teaneck, N.J.

[73] Assignee: Clyde, Sneider & Watson, Ltd., New York, N.Y.

[21] Appl. No.: 51,155

[22] Filed: Apr. 22, 1993

[51] Int. Cl.[5] ..... A63B 15/02; F21L 1/00

[52] U.S. Cl. ..... 362/102; 362/206

[58] Field of Search ..... 362/102, 202, 204, 205, 362/206, 207, 208

[56] References Cited

U.S. PATENT DOCUMENTS

| | | | |
|---|---|---|---|
| 1,855,015 | 4/1932 | Fraser et al. | 362/206 |
| 1,950,369 | 3/1934 | Klein | 362/102 |
| 2,257,227 | 9/1941 | Dater | 362/102 |
| 2,625,764 | 1/1953 | O'Brien et al. | 42/103 |
| 2,908,901 | 10/1959 | Lewis | 362/102 |
| 3,074,196 | 1/1963 | Bronson, Sr. | 362/102 |
| 3,737,649 | 6/1973 | Nelson et al. | 362/102 |
| 4,479,171 | 10/1984 | Mains | 362/102 |
| 4,486,807 | 12/1984 | Yanez | 361/232 |
| 4,495,551 | 1/1985 | Foltz | 362/208 |
| 4,559,588 | 12/1985 | Engelson et al. | 362/205 |
| 4,722,036 | 1/1988 | Hastings | 362/204 |
| 4,739,990 | 4/1988 | Aguirre et al. | 273/84 R |
| 4,823,242 | 4/1989 | Maglica et al. | 362/206 |
| 4,842,277 | 6/1989 | LaCroix | 362/102 |
| 5,003,440 | 3/1991 | Maglica | 362/202 |

*Primary Examiner*—Ira S. Lazarus
*Assistant Examiner*—L. Heyman
*Attorney, Agent, or Firm*—McAulay Fisher Nissen Goldberg & Kiel

[57] ABSTRACT

A combined flashlight-baton having a stick portion and a handle orthogonal thereto. The stick portion includes a hollow cylindrical chamber having a flashlight mechanism at one end thereof. The flashlight mechanism comprises a longitudinally slit metallic cylindrical member spring-biassed to widen the diameter thereof and the slit and fitably engaged with the inner chamber wall. Electrical contacts, first and second electrical contact members, a switch and a flashlight bulb are provided for energization. The handle has an axis transverse to the longitudinal axis of the stick portion and housing the switch. The handle portion has a housing for maintaining the location of the switch for operation with the same hand of the individual holding the combined flashlight-baton. Internal contacts and electrical connections are provided in the hollowed-out cylindrical chamber and the handle, the cylindrical member being part of the electric circuitry for the light mechanism.

20 Claims, 10 Drawing Sheets

COMBINATION BATON/LIGHT EMITTING DEVICE

BACKGROUND OF THE INVENTION

1. Field of the Invention

This invention relates to a combined baton and flashlight. More particularly, the invention is concerned with a combined flashlight baton for use in crowd control and self-protection.

Police officers currently carry a flashlight and a baton, but as separate units. According to police regulations in various jurisdictions, police officers are required to carry both a flashlight and a baton at night. From a practical standpoint, police officers often leave the baton in their vehicle, because they want to have at least one hand free and, in particular, their gun hand free.

This invention proposes to overcome the aforesaid difficulties by providing a combined flashlight and baton and having a unitary structure of such a combined baton-flashlight. Police officers would then have a free hand, should they need to have access to their gun. Because the baton portion is generally made of hard rubber, it is possible to include part of the flashlight operative mechanism in the handle and part of the operative portion in a stick portion of the baton. The switch and related operative mechanism related thereto are provided in the handle so as to be readily available to operate the flashlight portion while holding the baton and to leave the other hand free. With the switch outlet being in the handle portion of the baton and not the stick portion of the baton, the user has a large freedom of movement and usage. Further, the improved combined flashlight-baton includes the switch along the side of the handle for ease and rapidity of operation.

The present invention proposes various procedures for the use of the flashlight switch and, while the on-off switch can be at the tip, it is preferred to have a switch button at the shaft of the handle baton for better operation. It has also been found that the ease of operation is tremendously improved.

A flashlight is considered to be an offensive weapon, whereas the baton is considered to be a defensive weapon. By combining the two into a single unitary device, it is submitted that the combined baton-flashlight is considered to be a defensive weapon and not an offensive weapon, and the flashlight portion is an auxiliary portion of the combined baton flashlight.

2. Description of the Prior Art

There have been proposals made for a single unit which combines both a flashlight and a stick portion forming part of a baton into a single unit, but these have not established themselves for wide usage by police officers. In addition, batons currently used also include a handle coupled with the stick portion of the baton, and various attempts have been made heretofore to develop such a combined unit.

U.S. Pat. No. 3,737,649 to Nelson et al is one example of prior knowledge which is concerned with a baton-flashlight which includes a single barrel or housing having an elongated hollow metallic housing to receive a battery train and provided with a bulb enclosure to function as a flashlight with a switch provided on the outer circumference of the barrel proximate to the head portion containing the bulb. A spacer block is provided internally so that the operative portions of the flashlight do not have to extend the entire internal length of the flashlight-baton. This baton is not provided with a handle portion and, even if it were, the switch for the flashlight is provided on the stock portion.

U.S. Pat. No. 4,739,990 to Aguirre et al discloses a self-defense/attack device and includes a large elongated member adapted to contain a flashlight and a side handle projection to hold the device. The body is provided at one end, as an example, with a blunt tip and, at the other end, with means for providing a battery device, spray ejecting means and whistles, etc. The device is quite short, having a length which is not generally greater than the width of a human hand and, therefore, could be considered to be useful for carrying as a concealed device. This is not a police baton with a combined handle and stick portion.

U.S. Pat. No. 4,486,807 is a self-defense weapon which includes a single cylindrical member having an internal battery-operated mechanism in the form of a flashlight which can also generate internal flashes of visible light, piercing sound and electric shock.

U.S. Pat. No. 2,908,901 to Lewis is concerned with a protective device somewhat similar to a combined nightstick, flashlight and audible alarm, and includes a single cylindrical member having a flashlight bulb at one end, and an audible alarm in the body of the member. The audible alarm is activated if the stick is jarred or dropped onto the floor. This teaching is not directly pertinent to the subject matter of this invention because it does not have an orthogonal handle with a switch in the handle so as to provide for a suitable one-hand operation.

U.S. Pat. No. 2,625,764 is concerned with a combination flashlight, gun and billy, but does not show a handle transverse or orthogonal to the side, and the flashlight and gun are contained within the elongated body. The batteries extend the full length of the battery case and the switch is on the front collar.

U.S. Pat. No. 2,257,227 concerns a conventional nightstick with a flashlight at one end and a switch. A groove is provided near the handle portion to operate a switch to put the flashlight on and off.

U.S. Pat. No. 1,950,369 to Klein shows a hollow carrier for receiving the batteries in a flashlight baton and a strip 12 which runs along the vertical side of the cavity provides the electrical connection between the base of the batteries for spring 13 and one contact for lighting the bulb and the other contact goes through the center point of the bulb.

U.S. Pat. No. 4,479,171 to Mains discloses a baton having a stick portion with a flashlight at one end and a handle orthogonal to the stick portion. The handle includes a switch at the top end to activate the flashlight portion. The switch is basically operable from a single position in which the thumb of the user must be placed onto the end of the handle for operation of the switch, and the handle is rotatable relative to the stick portion to provide relative orientation with respect thereto.

SUMMARY OF THE INVENTION

The present invention proposes to provide a baton generally including a stick portion with a handle orthogonal thereto and combined with a flashlight which forms a self-contained unit with one end of the stick portion of the baton and with a light activating mechanism such as a switch in the handle portion and preferably along the axial direction of the shaft of the handle.

Other features of the invention are to provide for a reinforcement between the handle portion and the stick portion when a separate stick and handle are used together. The invention also provides for an internal sleeve which is fitted within the interior cavity in the stick portion to provide increased strength against breakage. The internal sleeve is a cylinder with a slit and provides for increased strength against breakage proximate to the handle. The invention also provides for ease of operation when one hand of a police officer is to be left completely free and the other hand can be used in connection with the baton as well as being able to operate and carry out the light function of the baton.

Depending upon the size of the flashlight unit used at one end of the stick portion, the stick portion can have an outer configuration in which the end of the stick portion with the flashlight unit includes a tapered outer configuration with the end having the largest diameter being at the flashlight end and tapering to a small diameter at the opposite end.

To these ends, the present invention comprises the provision of a combined flashlight-baton, including a stick portion and a handle orthogonal thereto. The stick portion includes a hollow cylindrical chamber having a mouth opening at one end of the stick portion and a flashlight mechanism contained within the hollow cylindrical chamber. The flashlight mechanism comprises a metallic cylindrical member having a longitudinal slit which is spring-biassed to widen the diameter thereof and the slit and it is fitably engaged with the inner wall of the chamber. A first electrical contact member is in electrical contact with the metallic cylinder and a switch, a second electrical contact member is provided which is isolated from the cylindrical member and the first electrical contact and is connected with the switch. A light mechanism is provided proximate to the one end for completing an electrical circuit through the switch and an electrical supply. The handle has an axis transverse to the longitudinal axis of the stick portion and houses the switch. The handle portion has means therein for maintaining the location of the switch for operation with the same hand of the individual holding the combined flashlight-baton.

The first electrical contact includes a spring element having a pair of free outer ends for spring contact with the slit cylindrical member for electrical contact therewith, and the pair of free outer ends are spring-biassed for contact either with the inner wall of the slit cylindrical member or an end thereof.

The cylindrical opening in one embodiment has a base portion and a ledge portion above the base portion. The first electrical contact includes a spring element having a pair of free outer ends for spring contact with the inner wall of the hollow cylindrical opening, and the base of the slit cylindrical member is press-fitted within the inner wall of the hollow cylindrical opening and bears onto the pair of free outer ends of the spring element for electrical contact therewith. The first electrical contact includes a center base portion having an electrical contact for coupling to one end of an electrical wire coupled to the switch and a pair of angulated spring-type arms extend from the base portion, each having a free end spring-biassed towards the inner wall of the hollow chamber and in contact with the base of the slit cylinder.

A lighting element is also provided at the mouth opening from the cylindrical chamber. The slit cylinder includes a flanged portion at the end thereof proximate to one end of the stick portion near the mouth of the cylindrical chamber. A spring is provided between the flanged portion and a lighting element bearing onto the flanged portion and the lighting element for urging thereof and the slit cylinder away from each other for urging the lighting element towards the mouth opening at the one end of the stick portion and forming one electrical contact between the lighting element through the slit cylinder to the first electrical contact. The other electrical contact is formed through the electrical supply between the lighting element and the second electrical contact member.

The switch which is used can be pressed to an on-condition and maintained in the on-condition and it can be held on when the user's finger is merely placed onto it, and for certain purposes, it can produce a blinking light for safety purposes.

In one embodiment, the handle and stick portion are two separate elements. The handle is connected to the stick portion, and a joint is formed between the stick portion and the handle. The handle includes a first chamber and a second chamber forming an inner chamber axially aligned with each other. The diameter of the first chamber is smaller than that of the second chamber to define a first ledge between the first and second chambers. The stick includes an inner opening substantially orthogonal to the hollow cylindrical chamber opening and axially aligned with the inner chamber, and the inner opening includes third and fourth chambers. The diameter of the fourth chamber is smaller than the diameter of the third chamber to define a second ledge between the third and fourth chambers. The second and third chambers are substantially coextensive when the stick portion and the handle are joined together and are axially aligned.

In one embodiment, a stiffener is received within the second and third chambers for imparting rigidity to the handle and the stick portion to prevent breakage of the handle at the connection to the stick portion at the joint. The stiffener is aligned with and juxtaposed to the inner walls of the second and third chambers.

A spring is also provided with one end in contact with the slit cylindrical member and a second end in contact with the light mechanism for urging them apart. The slit cylinder is urged into electrical contact with the first contact member by the spring. A second spring is positioned between a center contact of the lighting element and the batteries for urging them into electrical contact with the second electrical contact member.

Another embodiment provides for the stick portion and the handle to include two complementary half-sections with the stick part and the handle part, of each of the half-sections being formed of a single element so that each half stick portions and half handle form a unitary member. The two half-sections are joined together to form a composite unit with the handle and the stick portion being integral with each other and free of any seam between the handle portion and the stick portion. Joining can take place by cementing them or gluing them or by heat to weld them together. Alignment means are provided on the two half sections for alignment thereof for connection together. A recessed portion is provided in at least one of the two half-sections for retaining the switch, and a cut-out portion is provided in at least one of the two half-sections for receiving the wires connecting the switch with the first and second electrical contacts.

In another embodiment, the stick portion and the handle are molded as a single piece. One end of the stick portion has the chamber opening for receiving the slit cylinder. A longitudinal chamber is provided in the handle in communication with the stick portion chamber opening for receiving the electrical wires connecting the switch with the flashlight. A switch holder is provided in the handle portion for holding the switch and forming a closure for the longitudinal chamber and supporting the switch on the handle, preferably on the side of the handle.

In another embodiment, a uniformly molded stick portion and handle are provided having a chamber extending from one end and extending into the handle. A switch support is provided in the handle opening into the chamber in the handle. A switch closure is provided to provide access to the switch, with the closure forming part of a wall for the chamber in the handle.

The handle portion can be glued to the stick portion or connected by cement or welding.

The stick portion may be provided with an outer tapered surface which tapers from the flashlight end to the end opposite to the flashlight end to provide a uniform balance on each side of the handle.

The hollow cylindrical opening at the one end includes a first chamber for receiving the slit spring-biassed cylinder for engagement with the inner wall of the first chamber. A second chamber having a diameter smaller than the first chamber is provided and defines a ledge between the first and second chambers for controlling the extent the slit cylinder fits into the opening. To complete the flashlight portion, at one end at the outer circumference thereof, there is provided a male thread, and the flashlight includes a closure having an internal female thread for engagement with the male thread and holds the lighting element within the cylindrical opening.

DETAILED DESCRIPTION OF THE PREFERRED EMBODIMENTS

Figure 1:
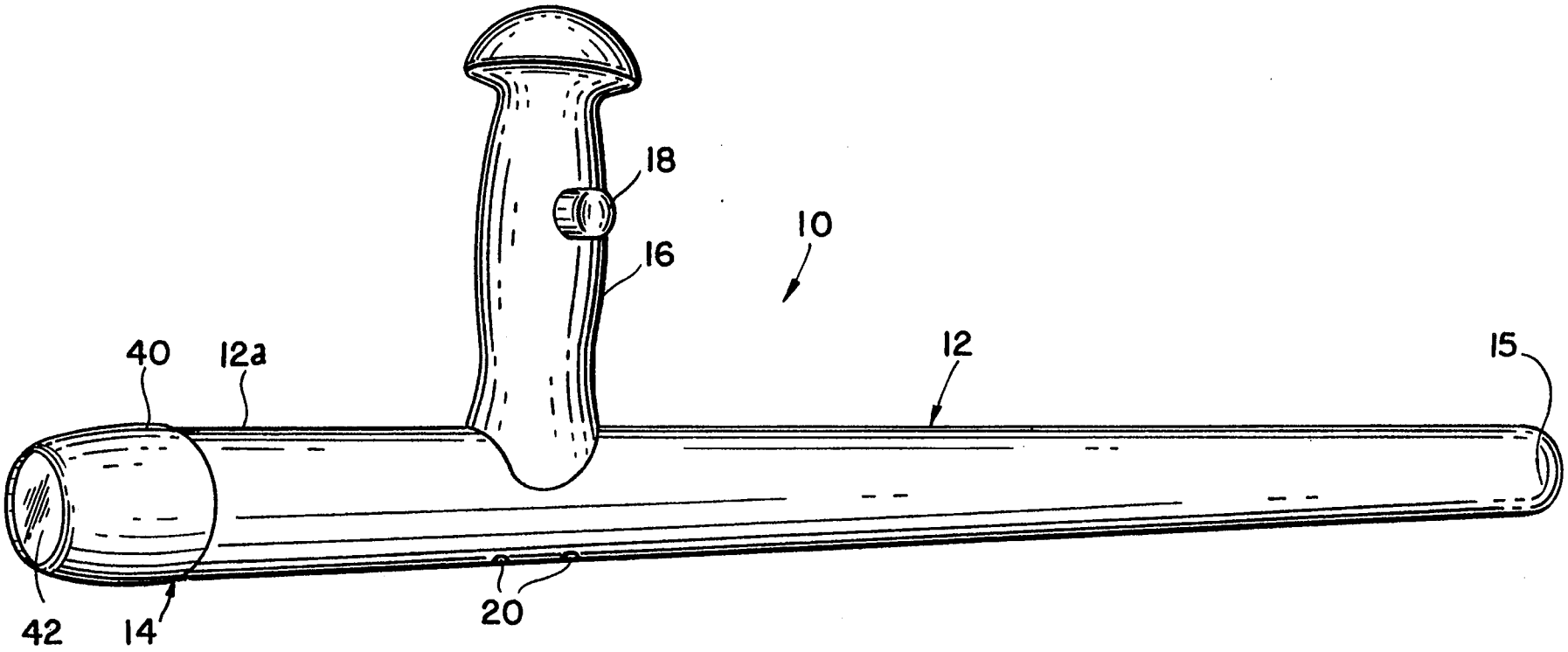
FIG. 1 is a perspective view of a combined baton-flashlight illustrating the outer configuration thereof according to the invention.

Referring now more particularly to the drawings which indicate the presently preferred modes of carrying out the invention, a combined flashlight-baton 10 is shown in FIG. 1 formed of a separate stick portion 12 having a flashlight portion 14 at one end thereof. The flashlight portion 14 is primarily encased within the stick portion 12 and they are aligned with each other along a longitudinal axis. A handle 16 having a switch 18 is connected with stick portion 12 and is orthogonal thereto. In FIG. 1, the stick portion is shown tapered from the end with the flashlight portion 14 to the opposite tip end 15 opposite to end 14 so that the stick portion is shown as tapering uniformly between 14 and 15.

The invention is concerned with different modes of manufacturing the combined flashlight-baton as well as the facility with which the flashlight portion can be integrated into the baton and in which the baton forms a suitable holder for the flashlight without impairing the use of the baton for its intended purpose.

Figure 3:
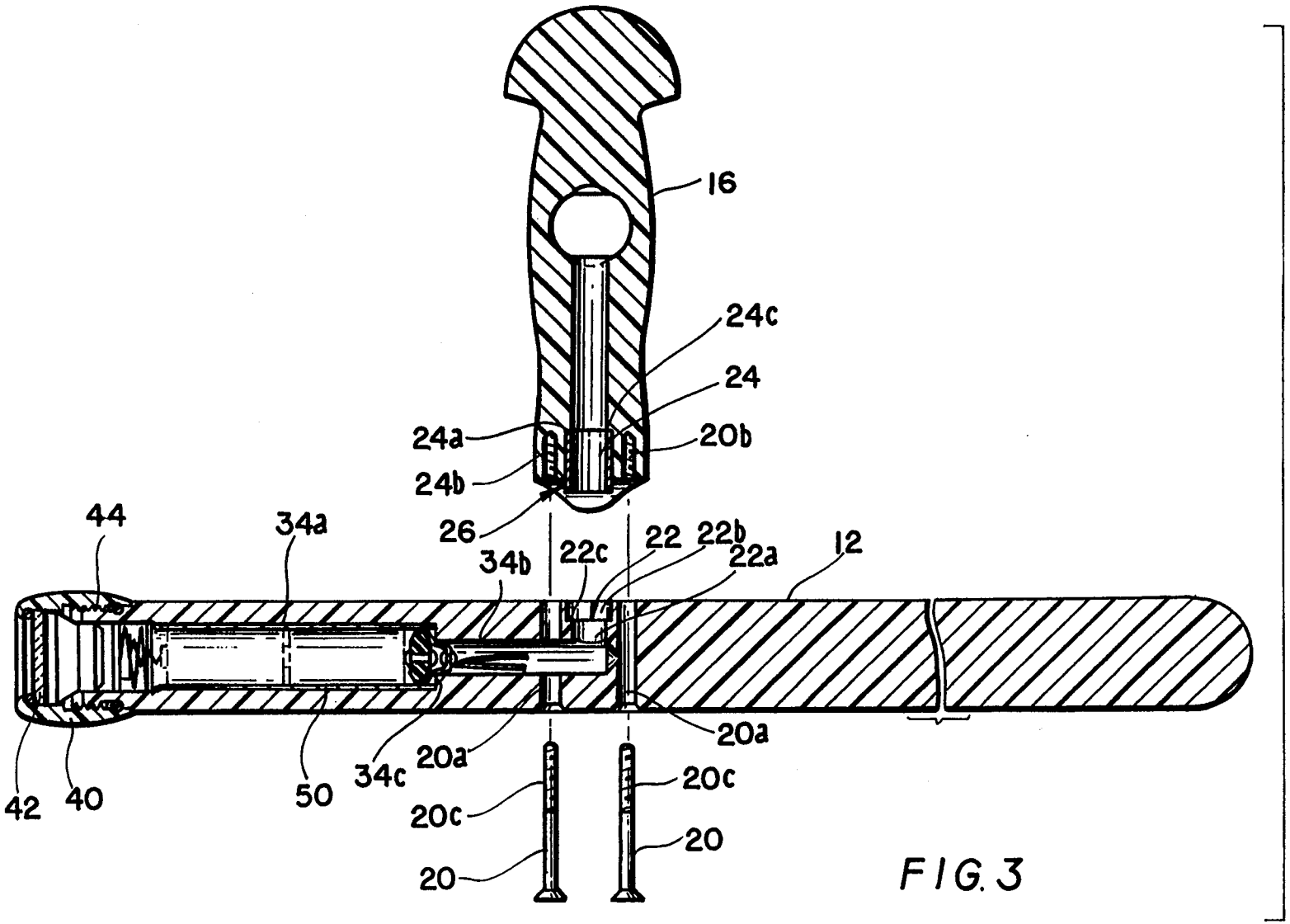
FIG. 3 is a longitudinal sectional view of the baton-flashlight shown in FIG. 2 taken along a central longitudinal axis with the handle portion separated from the stick portion.
Figure 4:
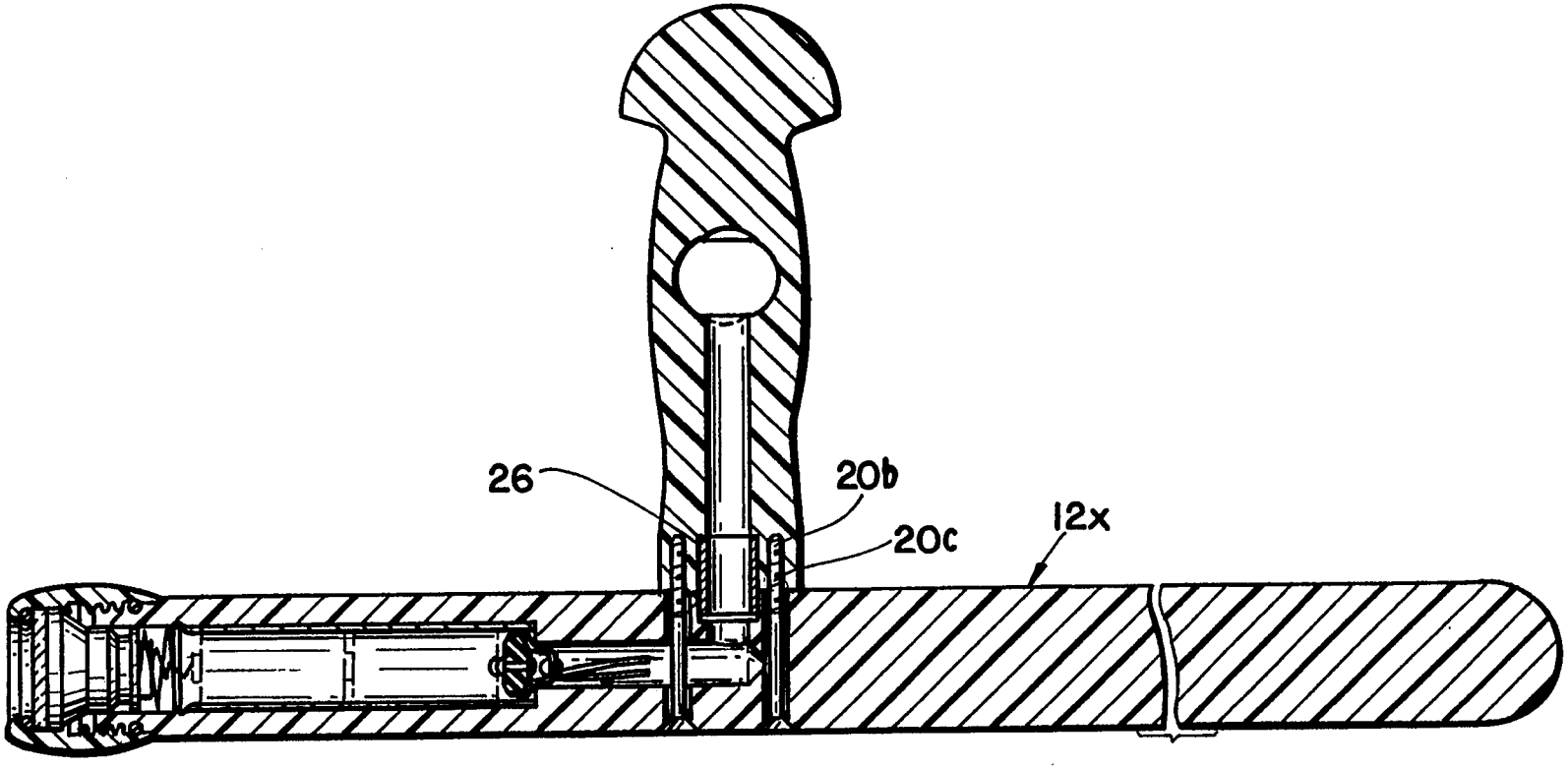
FIG. 4 is another longitudinal sectional view of the baton-flashlight with the handle portion in this embodiment connected with the stick portion and illustrating a stick portion with a substantially uniform diameter throughout its entire length.

As noted heretofore, the baton in FIG. 1 is shown tapered, and FIGS. 3 and 4 illustrate in detail the combination of the baton with the flashlight in one mode of manufacturing the baton. Other modes of manufacturing the baton which are all equally combined with the two different modes in which the flashlight portion 14 can be combined with baton 10.

Referring now more particularly to FIGS. 3 and 4, the combined flashlight-baton is shown with stick portion 12 having a uniform outer configuration extending along the longitudinal axis thereof and comprising a separate stick portion 12 and a separate handle portion 16. In this embodiment, one handle 16 can be used for both a left-handed and a right-handed person because access to switch 18 may be provided by merely rotating the handle through 180° before connection to stick portion 12.

In the FIGS. 3 and 4 embodiment, handle 16 is provided with two screws 20 which pass through openings 20*a* in stick portion 12 and are received in screw engaging recessed portion 20*b* having a female thread for connecting handle 16 and stick portion 12 together. Screws 20 are provided with male threads 20*c* for engagement with recessed portion 20*b* and the threads thereof.

In FIG. 4, handle 16 is connected with stick portion 12 and screw connecting portions 20*a* are engaged with the screw engaging recessed portions 20*b* by means of male threads 20*c*.

To provide for a stronger connection between the handle 16 and stick portion 12, stick portion 12 has a channel 22 orthogonal to the longitudinal axis of stick portion 12 which communicates with a channel 24 in handle 16, as will be explained subsequently, and channels 22 and 24 are axially aligned when handle 16 is screw connected with stick portion 12. Channel 22 includes a first sub-channel 22*a* and a second sub-channel 22*b* with channel 22*b* having a larger diameter so as to form a ledge 22*c* between the two channels 22*a* and 22*b*. In handle 16, channel 24 also includes two sub-channels 24*a* and 24*b* with a ledge 24*c* therebetween, channel 24*b* having a larger internal diameter than channel 24*a*. The inner diameters of channels 22*b* and 24*b* have the same diameter for receiving a stiffening element 26 partially in channel 22*b* and partially in channel 24*b*. Stiffening element 26 in addition to imparting strength at the connection also provides for more precise alignment between channels 22*b* and 24*b*. Stiffening element 26 is formed from stainless steel tubing in a preferred embodiment and has a thickness of preferably 0.50 inches and an axial length of 0.70 inches. At the base of stiffening element 26 which is cylindrical and snugly fits within channels 22*b* and 24*b* is an O-ring 28 which is compressed to provide a tight fit and seal between handle 16 and stick portion 12. The wiring is not shown, for the sake of clarity and explanation, but channels 22 and 24 are provided to extend connection wires 30, 32 (see FIGS. 8 and 9) to switch 18.

Figure 8:
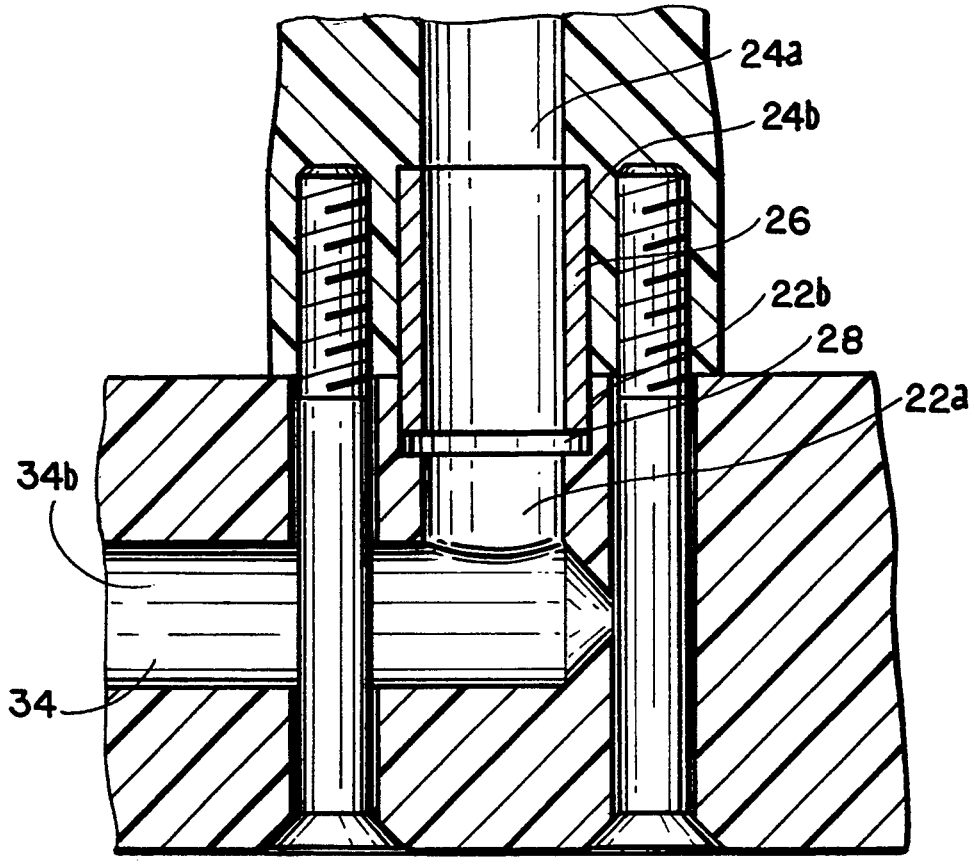
FIG. 8 is an enlarged view of the handle portion and stick portion connected together and provided with a reinforcement for the connection between the stick portion and the handle portion.
Figure 9:
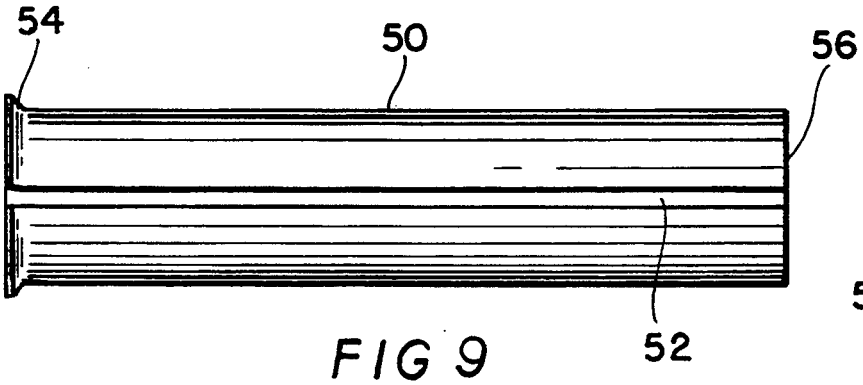
FIG. 9 is a longitudinal view of the inner split cylinder portion which is received within one end of the stick portion of the baton for the flashlight.

Stick portion 12 is also provided with a hollowed-out channel 34 which extends longitudinally of the longitudinal axis of the stick portion 12 and opens into channel 22 and, in particular, sub-channel 22*a*. Channel 34 also includes a first sub-channel 34*a* and a second sub-channel 34*b* separated by a ledge 34*c* with the diameter of sub-channel 34*a* being larger than sub-channel 34*b*. Channel 34*b* is provided for the wires 30 and 32. In FIG. 8, only sub-channel 34*b* which opens into sub-channel 22*a*.

Figure 11:
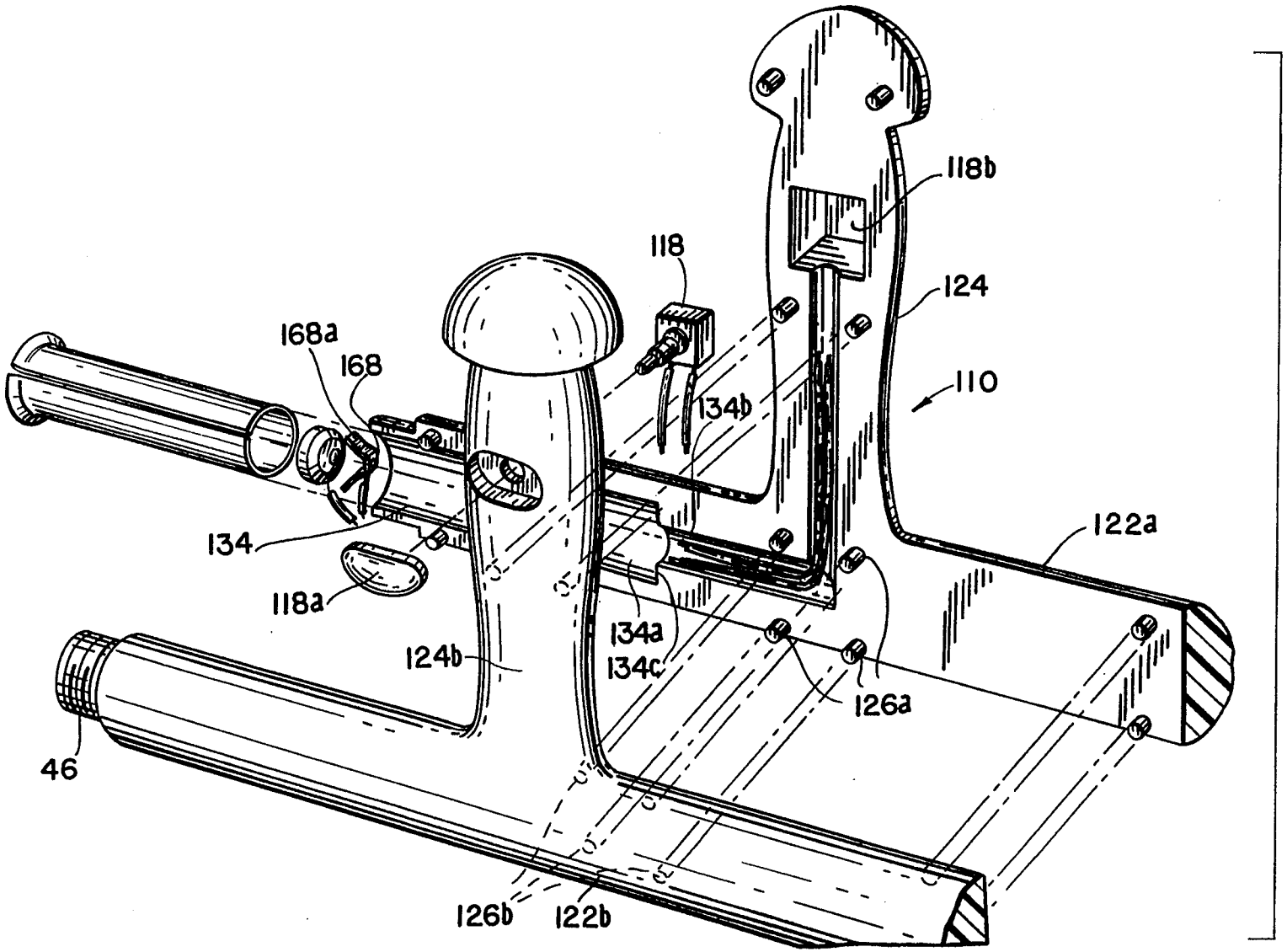
FIG. 11 is a modification of the FIG. 2 embodiment, illustrating a one-piece combined semi-handle and stick portion, two of which are complementary and cemented together to enclose the flashlight portion and provide a uniformly continuous handle-stick portion for the baton.

In FIG. 11, a modification of the combined flashlight-baton 110 is shown which is formed of two semi-cylindrical stick portions 122*a*, 122*b*, and with a combined and uniformly continuous semi-handle portion 124*a*, 124*b* having studs 126*a* in stick portion 122*a* for reception in openings 126*b* in semi-cylindrical stick portion 122*b*. Switch 118 is received in recessed portion 118*a*. The two parts of stick portions 122*a*, 122*b* and handle portions 124*a*, 124*b* are cemented, welded or glued together. These portions may also be heated to weld them or glue them together for a better bonding between the two parts. In this embodiment, a hollowed-out channel 124 is provided for switch 118 which is received in recessed portion 118*d*. Also, channel 134 is provided and includes first sub-channel 134*a* and second sub-channel 134*b* with ledge 134*c*. 168 is a metallic contact element together with spring element 168*a*, and cover 118*a*, which is made of a flexible plastic material.

The same parts will be described throughout with the same reference numerals, and similar parts will be designated with similar reference numerals which differ by 100, 200, 300, 400.

Figure 12:
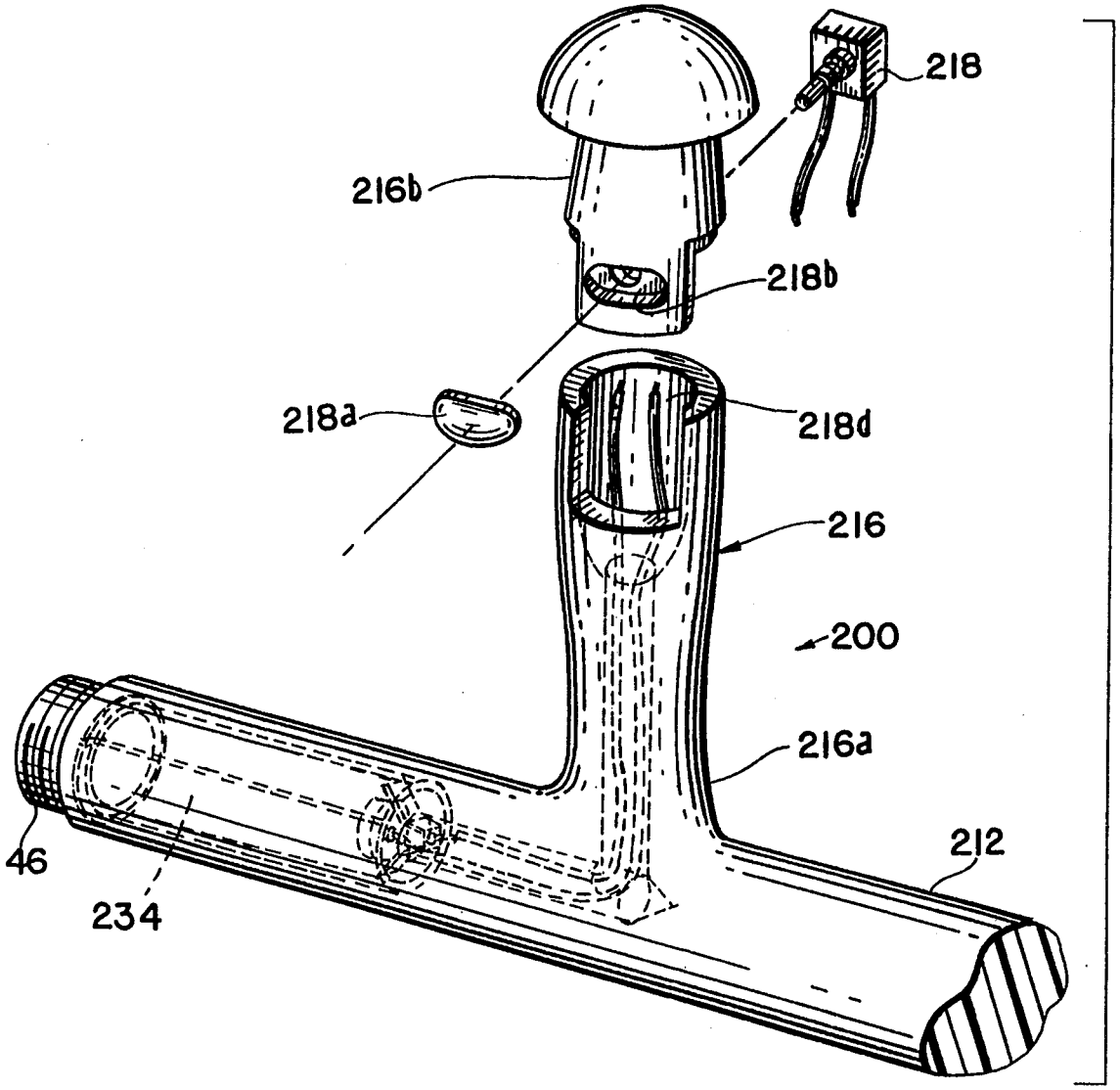
FIG. 12 is a modification of the FIG. 2 embodiment showing a combined unitarily molded handle and stick portion for the baton with provision made in the handle portion for reception of an on-off switch and for access to wiring and the on-off switch for the flashlight portion and a receptacle in one end of the stick for the flashlight portion.

Referring now to FIG. 12, which illustrates another combined flashlight-baton 200 formed from a substantially one-piece molded unit with the stick portion 212 and handle 216 uniformly connected and molded, welded, glued or cemented together. A switch 218 is received in a hollowed-out portion 220, and is covered with a flexible plastic material cover 218*a*. Ledge portion 218*b* is part of a recessed portion in handle closure 216*b* which connects with hollowed-out portion 220. Handle 216 includes a first handle part 216*a* formed unitarily with stick 212 and a second handle part forming the closure portion 216*b* which fits complementarily with the first handle part 216*a* and are glued, cemented or welded together to connect closure portion 216*b* to first handle part 216*a*. The stick portion 212 includes hollowed out channel 234 schematically shown.

Figure 13:
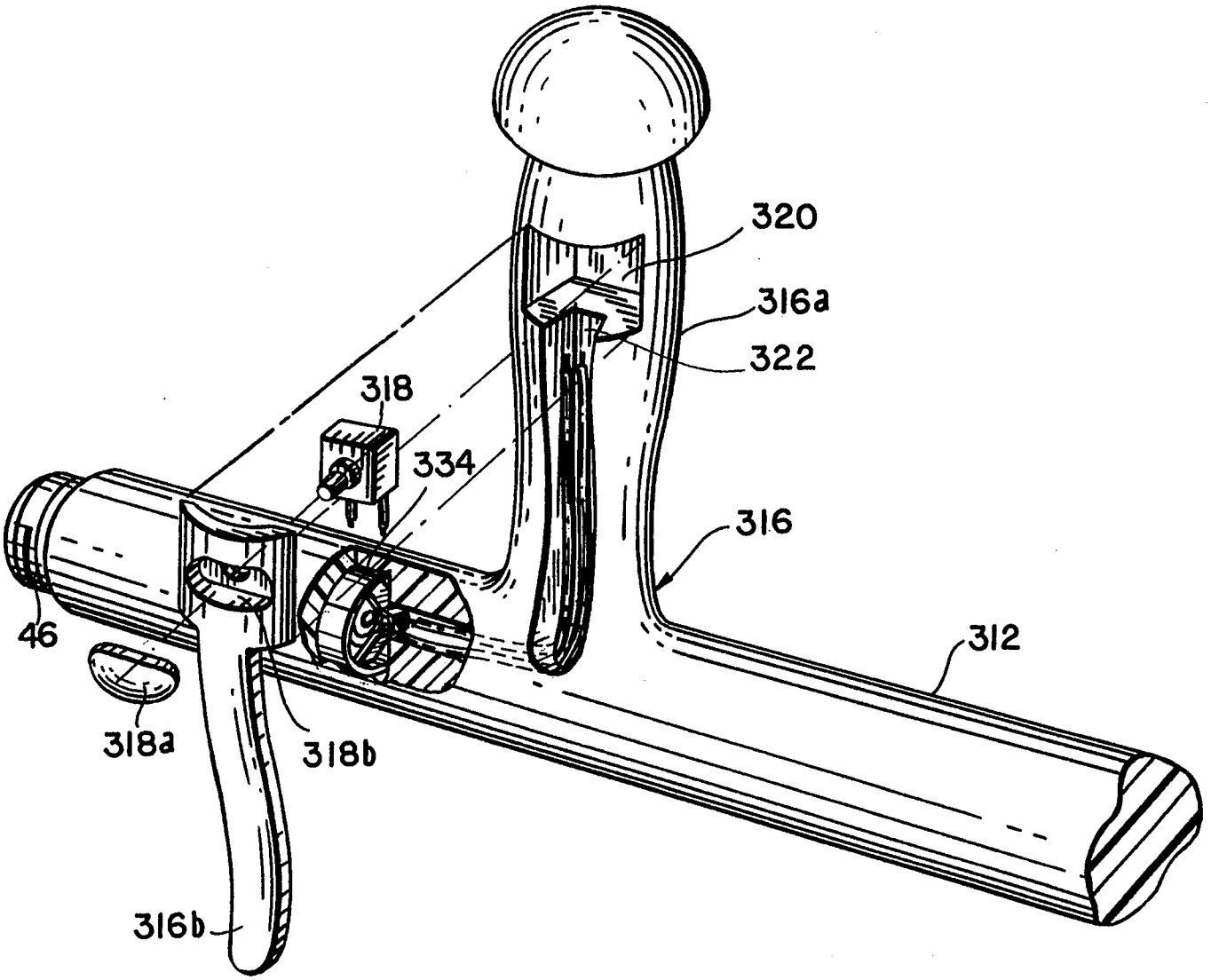
FIG. 13 is another modification illustrating a modified closure for the switch portion and access thereto through the handle in a unitarily molded combined handle and stick portion for a combined flashlight-baton.

FIG. 13 illustrates another modification in which stick portion 312 is uniformly formed with handle portion 316 to provide access to switch 318. Handle portion 316 includes a first handle portion 316*a* and a second handle portion forming a closure 316*b* which, together with handle portion 316*a*, forms a completely enclosed handle. A flexible plastic cover 318*a* is provided for switch 318 which is received within hollowed-out portion 320 in handle portion 316 and provides a ledge 318*b* for switch. Also, plastic flexible cover 318*a* fits within and is retained within recess 318 to cover the push-button portion of switch 318. Hollowed-out portion 320 connects with channel 322.

Figure 14:
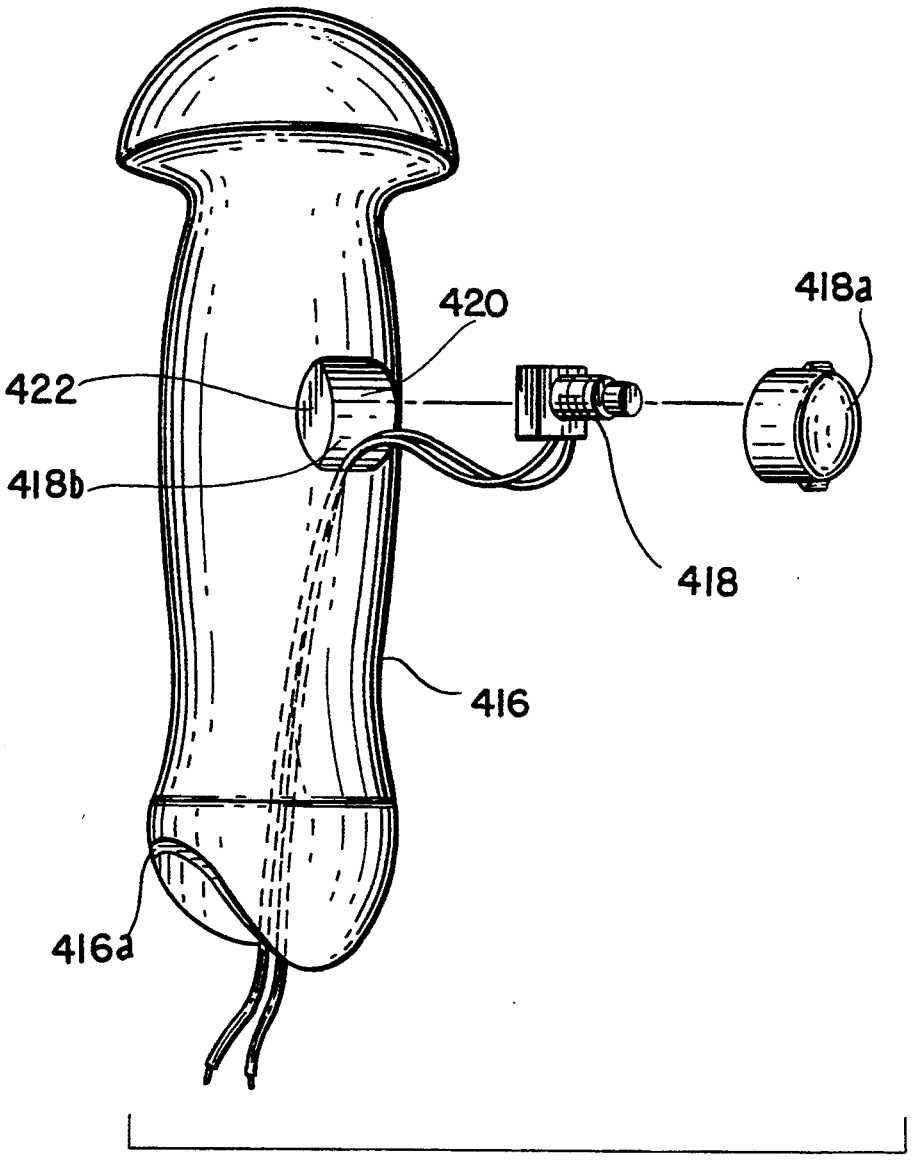
FIG. 14 is another modification of the handle portion for the combined flashlight-baton which can be cemented to the switch portion or connected with screws or other suitable means.

FIG. 14 illustrates another modification of handle 416 which is provided with switch 420 having a ledge 418*b* and received within hollowed-out portion 418*b* and is provided with a flexible plastic switch cover 418*a* to cover the moving parts of the switch 418. Handle 416 is shown provided with a curved portion 416*a* adapted to fit onto the outer surface of stick portion 12 in FIG. 1 and to be glued, cemented or welded to stick portion 12 after the appropriate electrical wiring is connected with the flashlight elements. In addition to securing handle 416 to stick 12, the handle 416 can also be connected with stick 12 by means of conventional screws 20. Also, in addition to gluing, the handle portion and stick portion can be heated to weld them together to provide for better bonding. Handle 416 can also be provided with stiffener or stiffening element 26. In this embodiment, as in the FIGS. 3 and 4 embodiment, the handle can be connected to the stick portion 12 so that the switch 18 is on either side of the handle and can be used by a left-handed or a right-handed person.

The flashlight portion in all of the embodiments, whether shown in each view or not, all include a conventional closure 40 for retaining a conventional lens 42. Closure 40 includes an inner female screw threaded portion 44 which is adapted to be received on outer male complementary threaded portion 46 at the flashlight end 12*a* of stick 12.

Figure 2:
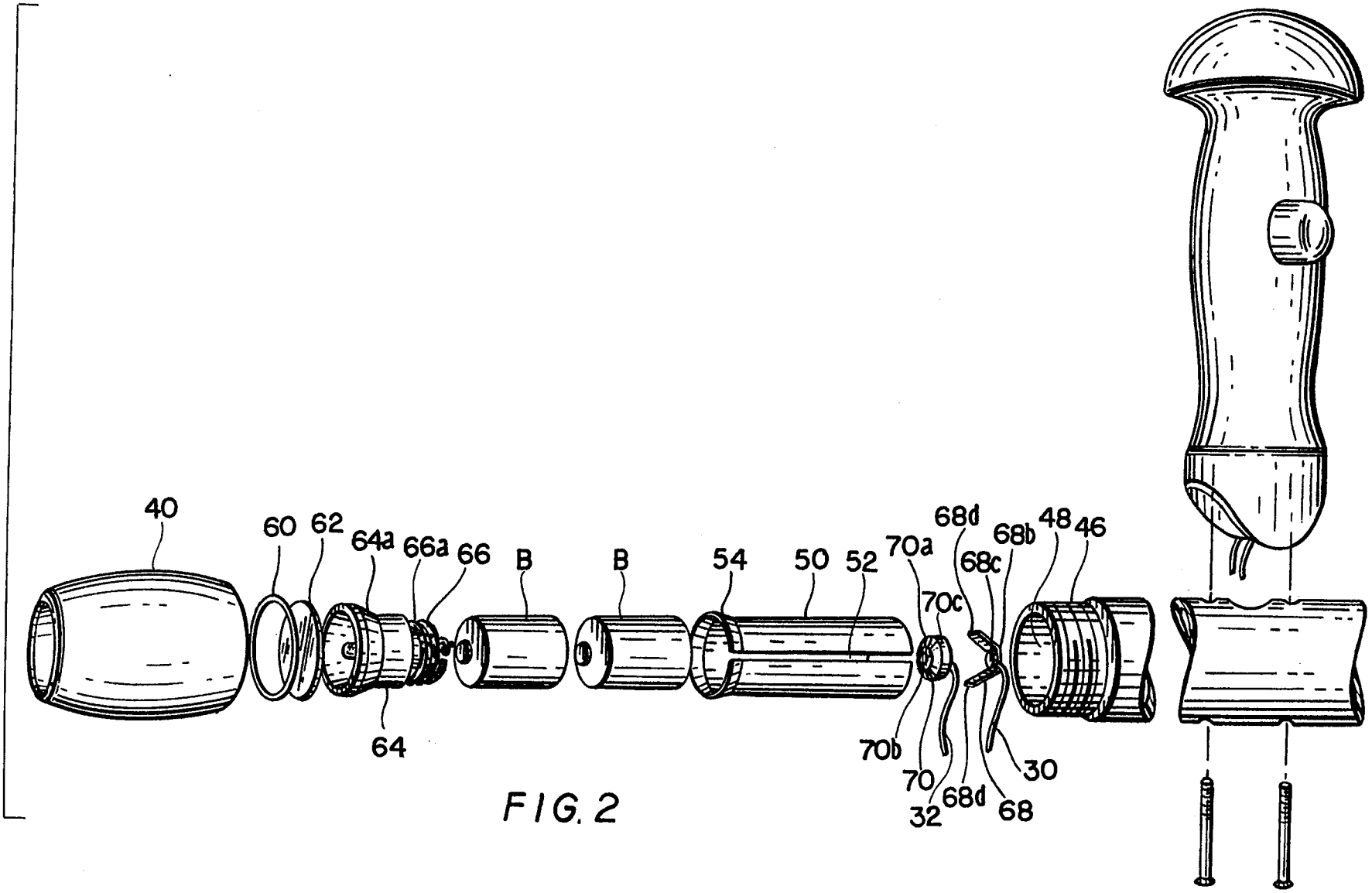
FIG. 2 is a partially exploded view of the flashlight portion which fits within one end of the baton and a handle portion separated from the stick portion, illustrating one embodiment of the invention.
Figure 6:
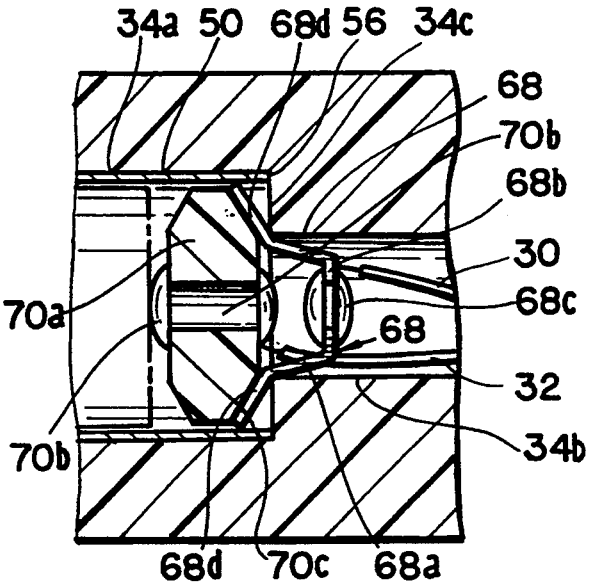
FIG. 6 is a view of one embodiment of the base portion of the flashlight mechanism within the stick portion of the baton.
Figure 10:
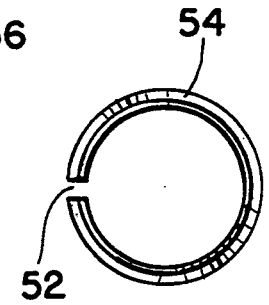
FIG. 10 is an end view of the split cylinder of FIG. 9.

Referring now more particularly to FIGS. 2 and 3, in which some of the component parts of the flashlight are removed from a hollowed-out interior 34*a* which is adapted to receive a split or slit elongated cylinder 50 (FIGS. 9 and 10) having an elongated slit 52 and an outer flanged portion 54. The base edge 56 of cylinder 50 rests on the bottom or ledge 34*c* of hollowed-out portion forming sub-chamber 34*a* and is in abutment therewith (FIG. 6) in one embodiment.

The flashlight portion in addition to closure 40 includes an O-ring 60, a lens 62, a reflector and bulb combination 64, spring 66 which is adapted to have one end 66*a* pressed against the outer truncated surface 64*a* of reflector bulb combination 64 and the other end 66*b* abut against the inner portion of flanged portion 54. Split cylinder 50 is press-fitted within the hollowed-out interior 34*a* and is moved into abutment with base edge 34*c*, in FIG. 6. The split cylinder 50 is adapted to receive the batteries B.

The flashlight portion also includes a first and a second metallic contact elements 68 and 70. Contact element 68 includes a spring element 68*a* having a flat portion 68*b* and a contact button or element 68*c* connected to one end of wire 30, the other end of which is connected to switch 18. Contact element 68 includes a pair of pressure contacting elements 68*d* which abut against the inside of cylinder 50 and, since cylinder 50 and elements 68*d* are both metal, electrical contact is made between cylinder 50 and contacting elements 68*d*. Slit 52 is sufficiently narrow that contacting elements 68*d* are always in electrical contact with split cylinder 50.

Figure 5:
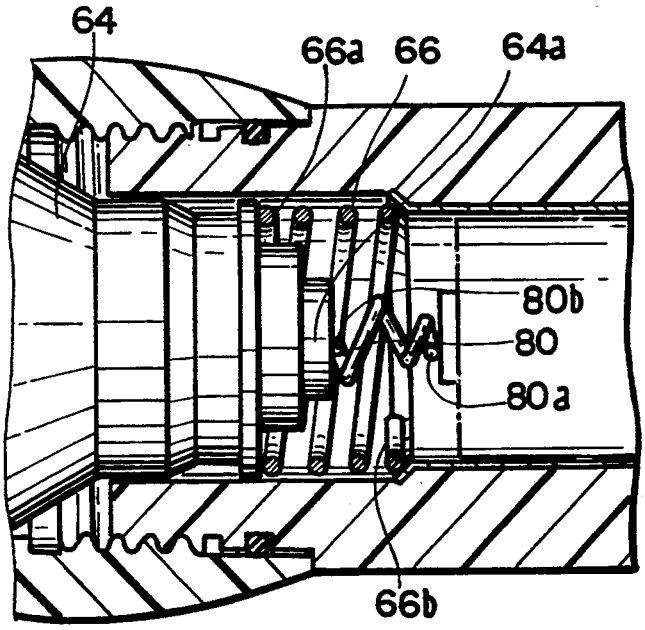
FIG. 5 is an enlarged partial view of the head of the flashlight component, illustrating the relationship among the light portion, an outer partial cylindrical sleeve within the stick portion of the baton, and the light bulb mechanism.

Contact element 70 which is connected with wire 32 includes an insulated portion 70*a* and a metallic button contact 70*b* which is connected with the other wire 32 that goes to switch 18. Insulated portion 70*a* (FIGS. 3 and 6) includes a side portion 70*c* which presses against elements 68*d* which together with spring 66 and a spring 80 having one end 80*a* bearing onto a center terminal of one of the batteries B and the other end 80*b* connected with the center portion 64*a* of the reflector bulb combination 66 (see FIG. 5).

Figure 7:
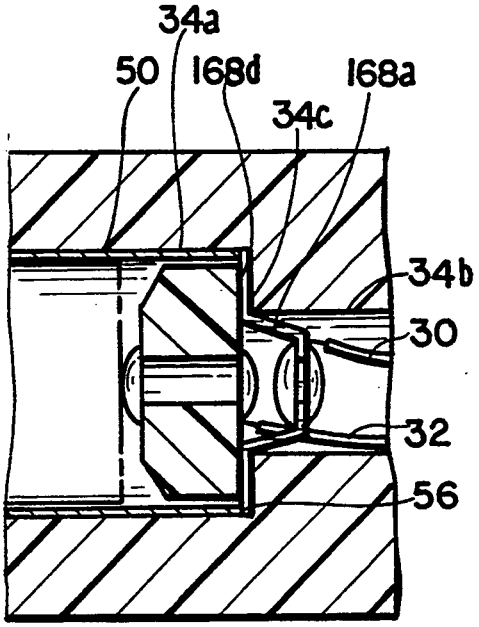
FIG. 7 is a view of another embodiment of the base portion of the flashlight shown in FIG. 6.

Referring now more particularly to FIG. 7, which includes first and second metallic contact elements 168 and 170. Contact element 168 includes a spring element 168*a* having a flat portion 168*b* which extends into channel 34*b* and a contact button or element 168*c* connected to one end of wire 30, the other end of which is connected to switch 18. Contact element 168 includes a pair of pressure contacting elements 168*d* which are pressure engaged with ledge 34*c* and held down thereagainst by base edge 56 of longitudinally slit elongated cylinder 50.

Contact element 170 cooperates with contacting elements 168*a* and includes an insulated portion 170*a* having a flat portion 170*d* in contact with contact elements 168*d*. Metallic button 168*c* is maintained spaced from metallic contact button 170*c* and is connected with wire 32 at one end thereof and the other end is connected with switch 18.

The stick portion 12 and handle are generally formed from the same material which is an electrical insulating material and is made from material such as nylon, black polycarbonate, polybutylene terephthalate, polyethylene terephthalate or equivalent.

The split cylinder is made from copper or aluminum and has a slit width in its expanded condition of approximately 0.06 inches or about 1/16 of an inch.

While there has been shown and described what are considered to be the preferred embodiments of the invention, various changes and modification may be made without departing from the scope of the invention.

We claim:

1. A combined flashlight-baton, comprising:

a stick portion and a handle portion orthogonal to said stick portion;

said stick portion including at one end thereof a hollow cylindrical chamber having a mouth opening at one end of said stick thereinto and a flashlight mechanism received within said hollow cylindrical chamber through said opening;

said flashlight mechanism comprising a metallic cylindrical member having a longitudinal slit, said cylindrical member being spring biased to widen the diameter thereof and said slit and fitably engaged with the inner wall of said chamber, first and second electrical contact members, said first electrical contact member including means urging said first electrical contact into electrical contact relationship with said metallic cylinder and a switch, means isolating said second electrical contact member from said cylindrical member and said first electrical contact and connected with said switch, and a light mechanism proximate to said one end completing an electrical circuit through said switch and an electrical supply means;

said handle portion having an axis transverse to the longitudinal axis of said stick portion and housing said switch, said handle portion having means therein for maintaining the location of said switch for operation with the same hand of the individual holding said combined flashlight-baton.

2. The device of claim 1, wherein said urging means includes a spring element having a pair of free outer ends for spring contact with said slit cylindrical member for electrical contact therewith.

3. The device of claim 2, wherein said pair of free outer ends are spring-biased for contact with the inner wall of said slit cylindrical member.

4. The device of claim 2, wherein said pair of free outer ends are spring-biassed for contact with an end of said slit cylinder.

5. The device of claim 1, wherein said cylindrical opening has a base portion and a ledge portion above said base portion, and said urging means includes a spring element having a pair of free outer ends for spring contact with the inner wall of said hollow cylindrical opening, and the base of said slit cylindrical member being press-fitted within said inner wall of said hollow cylindrical opening and bearing onto said pair of free outer ends of said spring element for electrical contact therewith.

6. The device of claim 1, wherein said first electrical contact member includes a center base portion having an electrical contact for coupling to one end of an electrical wire coupled to said switch and said urging means includes a pair of angulated spring-type arms extending from said base portion, each having a free end spring-biassed towards the inner wall of said hollow chamber and in contact with said slit cylinder.

7. The device of claim 1, including a lighting element at a mouth opening from said cylindrical chamber, said slit cylinder including a flanged portion at the end thereof proximate to said one end of said stick portion and said mouth of said cylindrical chamber, a lighting element for said flashlight at the mouth of said cylindrical chamber, a spring between said flanged portion and said lighting element bearing onto said flanged portion and said lighting element for urging said lighting element and said slit cylinder away from each other for urging said lighting element towards the mouth opening at said one end of said stick portion and forming one electrical contact between said lighting element through said slit cylinder to said first electrical contact, and forming the other electrical contact through said electrical supply means between said lighting element and said second electrical contact member.

8. The device according to claim 1, including connection means for connecting said handle portion to said stick portion, said handle portion and said stick portion being two separate element, said connection means forming a joint between said stick portion and said handle portion, said handle portion including inner chamber means comprising a first chamber and a second chamber axially aligned with each other, the diameter of said first chamber being smaller than said second chamber to define a first ledge between said first and second chambers, said stick portion including an inner opening means substantially orthogonal to said hollow cylindrical chamber opening and axially aligned with said inner chamber means, said inner opening means including third and fourth chambers and the diameter of said fourth chamber being smaller than the diameter of said third chamber to define a second ledge between said third and fourth chambers, said second and third chambers being substantially coextensive when said stick portion and said handle portion are joined together and being axially aligned, and a stiffener received within said second and third chambers for imparting rigidity to said handle portion and said stick portion to prevent breakage of said handle portion and said stick portion at said joint, said stiffener being aligned with and juxtaposed to the inner walls of said second and third chambers.

9. The device of claim 1, including a spring having one end in contact with said slit cylindrical member and a second in contact with said light mechanism for urging them apart and said slit cylinder into electrical contact with said first electrical contact member.

10. The device of claim 1, wherein said stick portion and said handle portion each include two complementary half-sections, each of said half-sections being formed of a single element so that each said half stick portions and said handle portions form a continuous unitary member, and means for joining said two half-sections together to form a composite unit with said handle portion and said stick portion being integral with each other free of any seam between the handle portion and the stick portion.

11. The device of claim 10, including a recessed portion in at least one of said two half-sections for retaining said switch, a cut-out portion in at least one of said two half-sections for receiving the wires connecting said switch with said first and second electrical contacts.

12. The device of claim 1, wherein said stick portion and said handle portion are molded as a single piece, said one end of said stick portion having said chamber opening, and a longitudinal chamber in said handle portion in communication with said stick chamber opening for receiving said electrical wires connecting said switch with said flashlight, and a switch holder in said handle portion for holding said switch and forming a closure for said longitudinal chamber and supporting said switch on said handle portion.

13. The device of claim 1, including a uniformly molded stick portion and handle portion having a chamber extending from said one end and extending into said handle portion, a switch support in said handle portion and opening into said chamber in said handle portion, and a closure for said switch to provide access to said switch, said closure forming part of a wall for said chamber in said handle portion.

14. The device of claim 1, wherein said hollow cylindrical opening at said one end includes a first chamber for receiving said slit spring-biassed cylinder for engagement with the inner wall of said first chamber, a second chamber having a diameter smaller than said first chamber and defining a ledge between said first and said second chambers for controlling the extent said slit cylinder fits into said opening, said urging means being received within said second chamber for contact with said slit spring biassed cylinder in said first chamber.

15. A combined flashlight-baton, comprising:

a stick portion and a handle portion orthogonal to said stick portion;

said stick portion including at one end thereof a hollow cylindrical chamber having a mouth opening at one end of said stick and a flashlight mechanism received within said hollow cylindrical chamber through said mouth opening;

said flashlight mechanism comprising a metallic cylindrical member having a longitudinal slit, said cylindrical member being spring biassed to widen the diameter thereof and said slit and fitably engaged with the inner wall of said chamber, first and second electrical contact members, said first electrical contact member being in electrical contact with said metallic cylinder and a switch, means isolating said second electrical contact member from said cylindrical member and said first electrical contact and connected with said switch, and a light mechanism proximate to said one end completing an electrical circuit through said switch and an electrical supply means;

said handle portion having an axis transverse to the longitudinal axis of said stick portion and housing said switch, said handle portion having means therein for maintaining the location of said switch for operation with the same hand of the individual holding said combined flashlight-baton; and said first electrical contact including a spring element having a pair of free outer ends for spring contact with said slit cylindrical member for electrical contact therewith.

16. The device of claim 15, wherein said stick portion and said handle portion each include two complementary half-sections, each of said half-sections being formed of a single element so that each said half stick portions and said handle portions form a continuous unitary member, and means for joining said two half-sections together to form a composite unit with said handle portion and said stick portion being integral with each other free of any seam between the handle portion and the stick portion.

17. The device of claim 15, wherein said cylindrical opening has a base portion and a ledge portion above said base portion, and said first electrical contact including a spring element having a pair of free outer ends for spring contact with the inner wall of said hollow cylindrical opening, and the base of said slit cylindrical member being press-fitted within said inner wall of said hollow cylindrical opening and bearing onto said pair of free outer ends of said spring element for electrical contact therewith.

18. A combined flashlight-baton, comprising:

a stick portion and a handle portion orthogonal to said stick portion;

said stick portion including at one end thereof a hollow cylindrical chamber having a mouth opening at one end of said stick thereinto and a flashlight mechanism received within said hollow cylindrical chamber through said opening;

said flashlight mechanism comprising a metallic cylindrical member having a longitudinal slit, said cylindrical member being spring biassed to widen the diameter thereof and said slit and fitably engaged with the inner wall of said chamber, first and second electrical contact members, said first electrical contact member being in electrical contact with said metallic cylinder and a switch, means isolating said second electrical contact member from said cylindrical member and said first electrical contact and connected with said switch, and a light mechanism proximate to said one end completing an electrical circuit through said switch and an electrical supply means;

said handle portion having an axis transverse to the longitudinal axis of said stick portion and housing said switch, said handle portion having means therein for maintaining the location of said switch for operation with the same hand of the individual holding said combined flashlight-baton; and a uniformly molded stick portion and handle portion having a chamber extending from said one end and extending into said handle portion, a switch support in said handle portion and opening into said chamber in said handle portion, and a closure for said switch to provide access to said switch, said closure forming part of a wall for said chamber in said handle portion.

19. The device of claim 18, wherein said stick portion and said handle portion each include two complementary half-sections, each of said half-sections being formed as a single element so that each said half stick portions and said handle portions when joined form a unitary member, and means for joining said two half-sections together to form a composite unit with said handle portion and said stick portion being integral with each other free of any seam between the handle portion and the stick portion.

20. The device of claim 18, including a lighting element at a mouth opening from said cylindrical chamber, said slit cylinder including a flanged portion at the end thereof proximate to said one end of said stick portion and said mouth of said cylindrical chamber, a lighting element for said flashlight at the mouth of said cylindrical chamber, a spring between said flanged portion and said lighting element bearing onto said flanged portion and said lighting element for urging said lighting element and said slit cylinder away from each other for urging said lighting element towards the mouth opening at said one end of said stick portion and forming one electrical contact between said lighting element through said slit cylinder to said first electrical contact, and forming the other electrical contact through said electrical supply means between said lighting element and said second electrical contact member.

* * * * *